US006318893B1

(12) United States Patent
Gates

(10) Patent No.: US 6,318,893 B1
(45) Date of Patent: Nov. 20, 2001

(54) BAG FOR AUTOMATED FILING AND SEALING MACHINE

(75) Inventor: Anthony H. Gates, Atwater, OH (US)

(73) Assignee: Gates Automation, Inc., Sebring, OH (US)

( * ) Notice: Subject to any disclaimer, the term of this patent is extended or adjusted under 35 U.S.C. 154(b) by 0 days.

(21) Appl. No.: 09/563,614

(22) Filed: May 2, 2000

(51) Int. Cl.[7] ..... B65D 33/00

(52) U.S. Cl. ..... 383/200; 206/554; 383/107; 383/903

(58) Field of Search ..... 383/200, 903, 383/33, 107, 108; 206/554

(56) References Cited

U.S. PATENT DOCUMENTS

| | | | | |
|---|---|---|---|---|
| D. 306,555 | * | 3/1990 | Lane et al. | D9/305 |
| D. 312,569 | * | 12/1990 | Wijas | D9/345 |
| D. 319,176 | * | 8/1991 | Sherman | D9/305 |
| D. 386,398 | * | 11/1997 | Davis | D9/305 |
| D. 418,747 | * | 1/2000 | Sagel | D9/305 |
| D. 438,793 | * | 3/2001 | Croft | D9/415 |
| 1,007,918 | * | 11/1911 | Chambers | 383/33 |
| 2,329,360 | * | 9/1943 | Salfisberg | 383/200 |
| 2,999,627 | * | 9/1961 | Reinhardt | 383/200 |
| 3,008,837 | * | 11/1961 | Kaplan | 383/200 |
| 3,054,551 | * | 9/1962 | Holbrook et al. | 383/206 |
| 3,155,282 | * | 11/1964 | Leblanc | 383/200 |
| 3,372,857 | * | 3/1968 | Brayla | 383/903 |
| 3,625,351 | * | 12/1971 | Eisenberg | 383/200 |
| 3,768,725 | * | 10/1973 | Pilaro | 383/200 |
| 3,799,914 | * | 3/1974 | Schmit et al. | 383/200 |
| 3,980,225 | * | 9/1976 | Kan | 383/107 |
| 3,983,994 | * | 10/1976 | Wyslotsky | 383/200 |
| 4,007,838 | * | 2/1977 | Awad | 206/484 |
| 4,176,567 | * | 12/1979 | Weisberg | 83/30 |
| 4,263,768 | * | 4/1981 | Russell et al. | 53/384 |
| 4,509,196 | * | 4/1985 | Sak et al. | 383/5 |
| 4,598,826 | * | 7/1986 | Shinbach | 383/200 |
| 4,759,643 | * | 7/1988 | Canno | 383/84 |
| 4,903,841 | * | 2/1990 | Ohsima et al. | 383/200 |
| 4,961,503 | * | 10/1990 | Bell | 383/200 |
| 5,018,646 | * | 5/1991 | Billman et al. | 222/107 |
| 5,046,621 | * | 9/1991 | Bell | 383/200 |
| 5,419,638 | * | 5/1995 | Jamison | 383/100 |
| 5,470,419 | * | 11/1995 | Sasaki et al. | 383/200 |
| 5,795,071 | * | 8/1998 | Sasaki et al. | 383/200 |
| 5,894,929 | * | 4/1999 | Kai et al. | 383/100 |
| 6,120,183 | * | 9/2000 | Buchanan et al. | 383/122 |

* cited by examiner

*Primary Examiner*—Stephen P. Garbe
(74) *Attorney, Agent, or Firm*—Sand & Sebolt

(57) ABSTRACT

A sealable bag for storing merchandise includes a body having a pocket that is adapted to receive the merchandise. The pocket has an opening through which merchandise is placed into the pocket. The body has a pair of flanges disposed along the sides of the body. The body has a neck with the opening of the pocket being disposed at the neck of the body. The neck has a sealing area. The bag includes a pair of stress relief notches disposed in the flanges intermediate the sealing area and the opening of the pocket. The stress relief notches prevent the sealing area from becoming wrinkled while the bag is being sealed with automated equipment thus allowing a clean, unwrinkled seal to be formed in the bag.

20 Claims, 7 Drawing Sheets

BAG FOR AUTOMATED FILING AND SEALING MACHINE

BACKGROUND OF THE INVENTION

1. Technical Field

The present invention generally relates to bags and, more particularly, to bags that are filled and then sealed to hermetically seal the contents within the bag. Specifically, the present invention relates to a sealable bag having a pair of stress relief areas that prevent the area of the bag that is to be sealed from being wrinkled during the sealing process. The invention also relates to the method of holding, filling, and sealing the bags.

2. Background Information

Various products are now being packaged in sealed bags that allow the consumer to break the initial seal and then selectively seal and reseal the bag with a secondary closure member. These bags are primarily fabricated from flexible plastic or metalized plastic. Some bags have gusseted bottoms that must be opened prior to filling the bag. For this reason and others, many bag filling operations have been performed manually. Problems sealing the bags in manual operations were not encountered because the person filling the bag and passing it on to the sealing machine could smooth the sealing area before the sealing machine sealed the bag.

As a result in the increased popularity of these bags, automated filling and sealing devices have been invented to increase the efficiency of filling and sealing the bags. One such machine is disclosed in pending patent application Ser. No. 60/161,772, filed Oct. 27, 1999. The disclosures of this application are incorporated herein by reference in order to fully disclose how these machines operate. In this machine, a pair of fingers grab the top corners of the bag to pull the top of the bag taut so that it may be sealed. A problem in the art is that some bags wrinkle in the sealing area when pulled taut. The wrinkles degrade the appearance of the resulting seal and may degrade the effectiveness of the seal. Some consumers have refused to use the automated machinery to fill and seal their bags until the wrinkling problems can be solved.

SUMMARY OF THE INVENTION

In view of the foregoing, an objective of the present invention is to provide a bag for an automated filling and sealing machine that eliminates the wrinkling problem caused by the fingers that pull the sides of the bag apart.

Another objective of the present invention is to provide a bag that may be used with the automated machinery and that will be accepted by the consumers who use the bags.

Another objective of the present invention is to provide a solution that may be incorporated into existing bags without requiring the existing bag structure to be altered.

Another objective of the present invention is to provide a bag that may be used with existing automated filling and sealing machinery as well as the manual filling and sealing systems.

Another objective of the present invention is to provide a method for automatically filling and sealing bags without wrinkling the area of the bag to be sealed.

These and other objectives and advantages of the invention are achieved by a sealable bag for storing merchandise, the bag including a body forming a pocket that is adapted to receive the merchandise; the pocket having an opening through which merchandise is placed into the pocket; the body having a pair of flanges disposed along the sides of the body; the body having a neck; the opening of the pocket being disposed at the neck of the body; the neck having a sealing area; and each of the flanges defining a stress relief notch disposed intermediate the sealing area and the opening of the pocket.

Other objectives and advantages of the invention are achieved by a sealable bag for storing merchandise, the bag including a body forming a pocket that is adapted to receive the merchandise; the pocket having an opening through which merchandise is placed into the pocket; the body having a pair of flanges disposed along the sides of the body; the neck having a sealing area; and each of the flanges defining a stress relief notch disposed intermediate the sealing area and the opening of the pocket.

Still other objectives and advantages of the invention are achieved by a method of sealing a bag including the steps of providing a bag having an opening, a pair of upper corners at the edges of the opening, a sealing area, and pair of flanges that each define a stress relief notch intermediate the sealing area and the opening; grasping the upper corners of the bag with fingers; pulling the upper corners of the bag away from each other; and forming a seal in the sealing area of the bag.

BRIEF DESCRIPTION OF THE DRAWINGS

The preferred embodiment of the invention, illustrative of the best mode in which applicant contemplated applying the principles of the invention, is set forth in the following description and is shown in the drawings and is particularly and distinctly pointed out and set forth in the appended Claims.

Similar numbers refer to similar parts throughout the specification.

DESCRIPTION OF THE PREFERRED EMBODIMENTS

Figure 1:
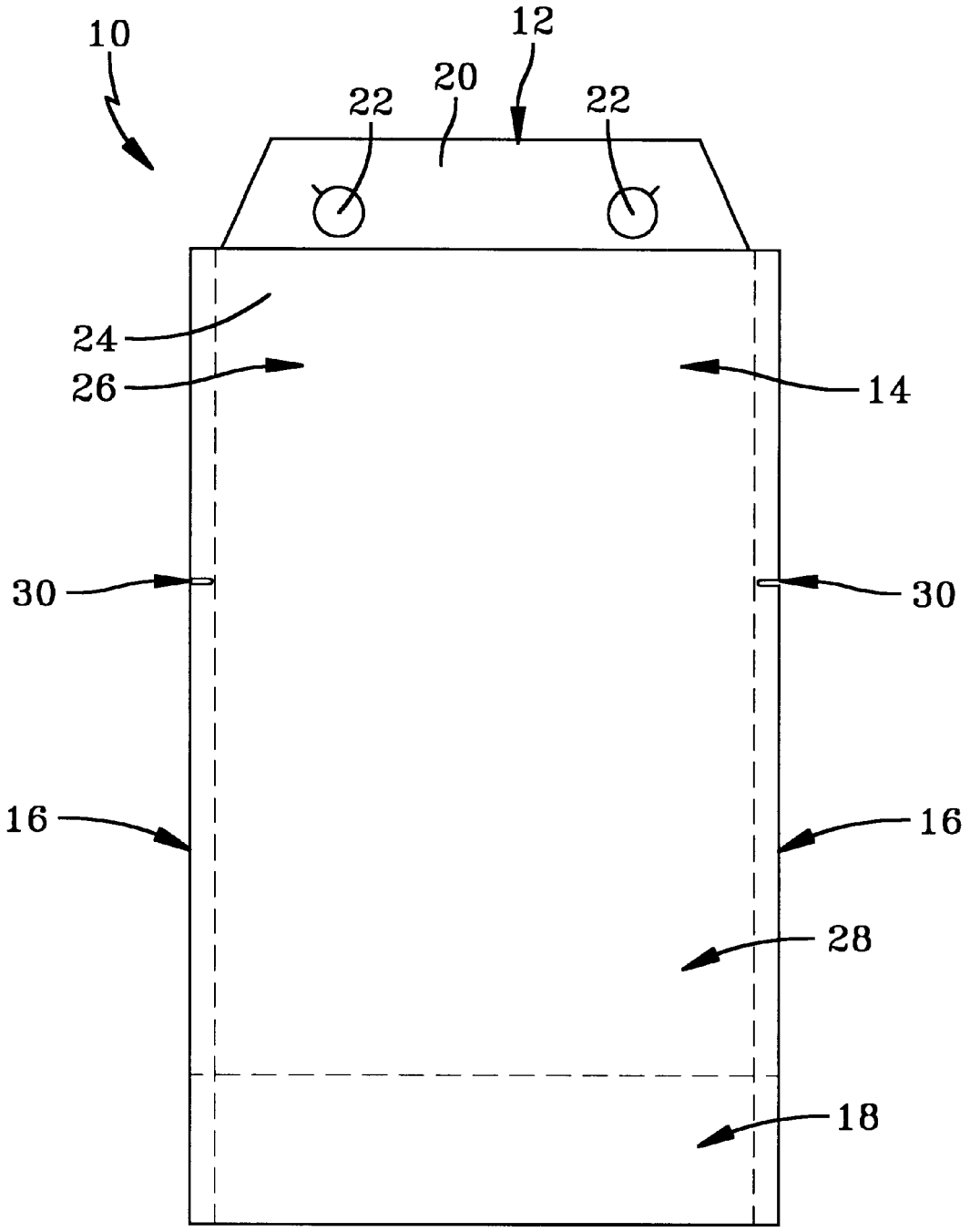
FIG-1 PRIOR ART
FIG. 1 is a front plan view of a prior art bag.
Figure 2:
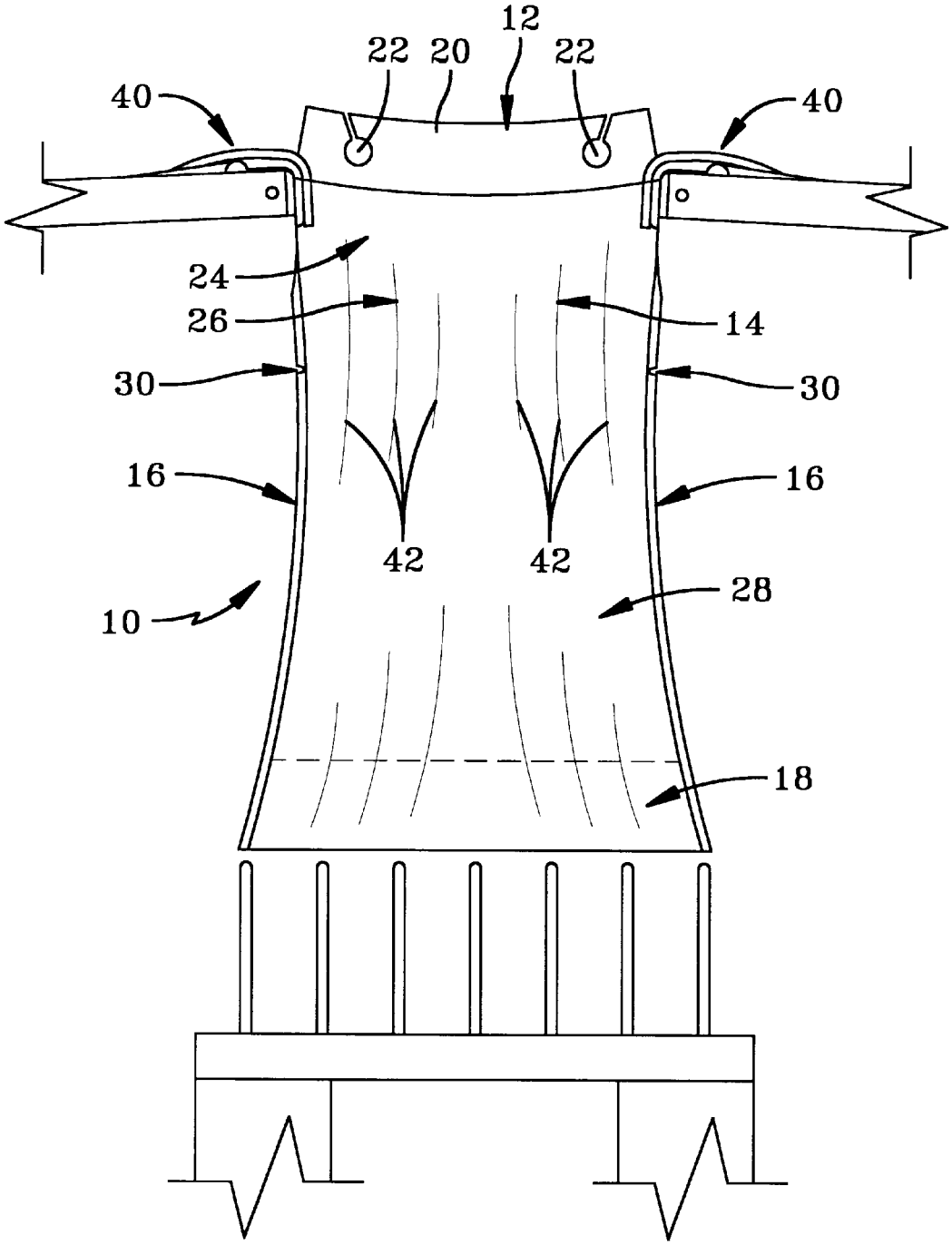
FIG-2 PRIOR ART
FIG. 2 is a front plan view of the prior art bag disposed in a filling and sealing machine with the fingers of the machine grasping the upper corners of the bag.
Figure 3:
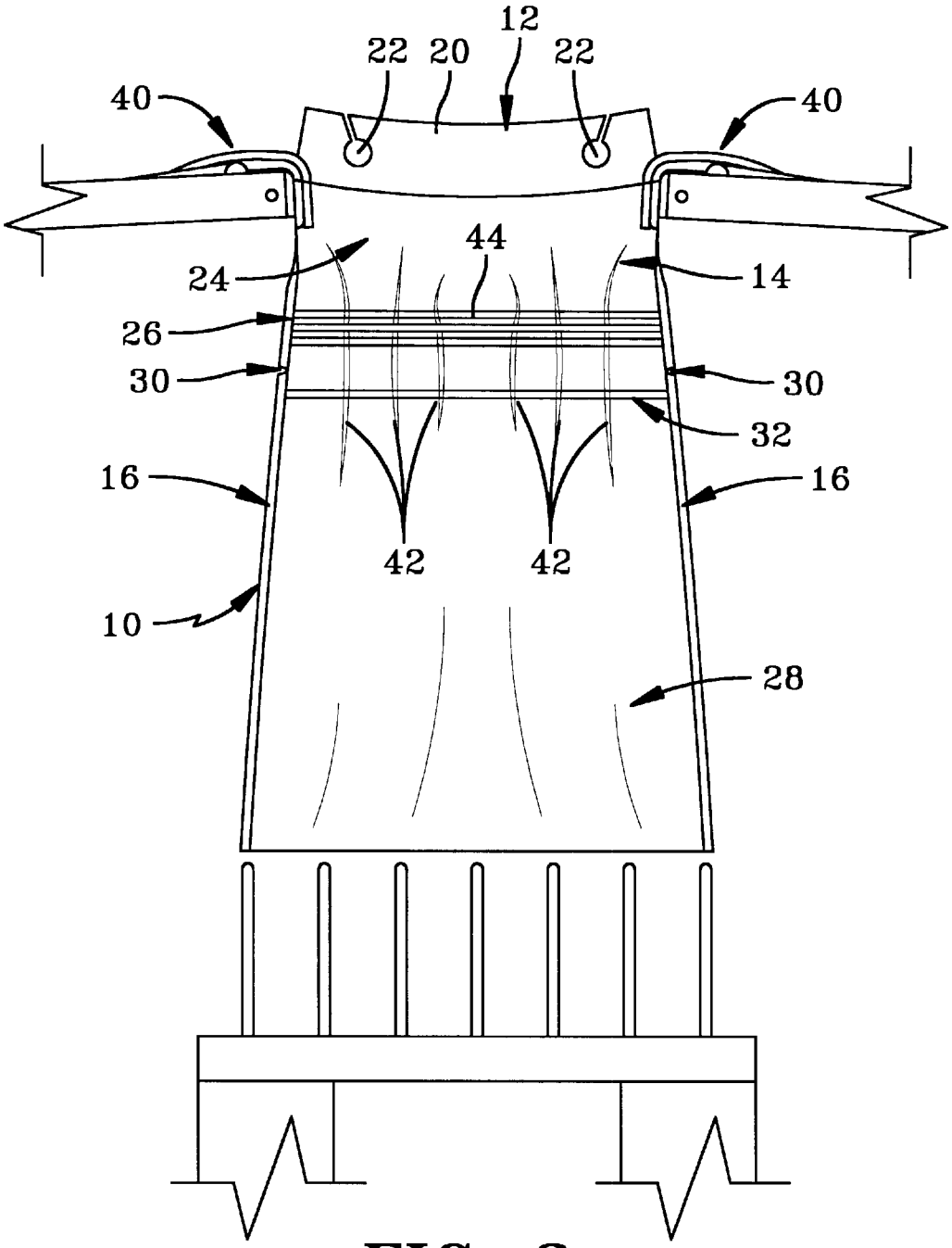
FIG-3 PRIOR ART
FIG. 3 is a view similar to FIG. 2 showing the wrinkling created in the sealing area of the prior art bag.
Figure 4:
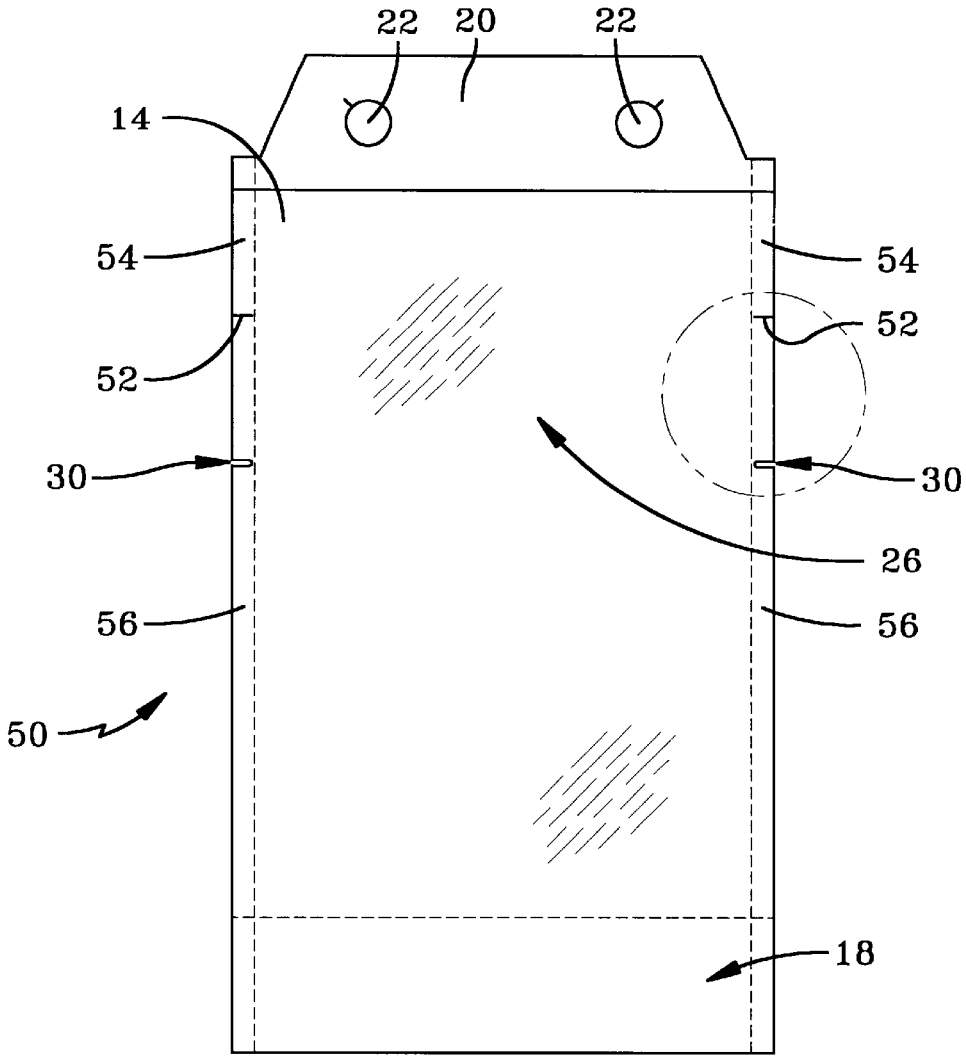
FIG. 4 is a front plan view of the bag of the present invention.
Figure 5:
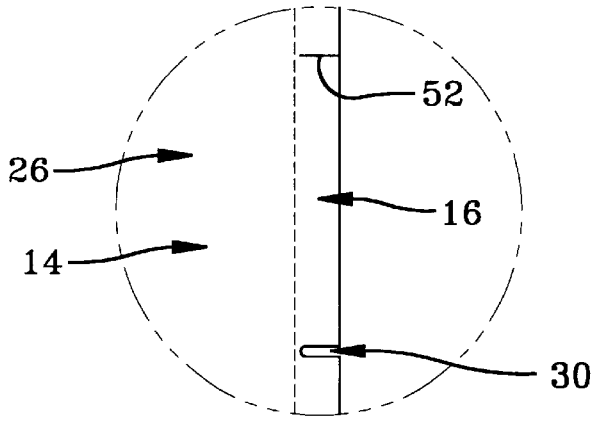
FIG. 5 is an enlarged view of the encircled portion of FIG. 4.

A prior art bag is depicted in FIGS. 1–3 and is indicated generally by the numeral 10. Bag 10 is formed from first 12 and second 14 sheets by sealing the longitudinal edges of sheets 12 and 14 and joining the bottom edges of sheets 12 and 14 to form a pocket having an open end. Sealing the edges of sheets 12 and 14 results in flanges 16 being disposed along the longitudinal edges of bag 10. In the embodiment of prior art bag 10 depicted in FIGS. 1–3, bag 10 is gusseted as indicated by the numeral 18 so that the bottom of bag 10 may be opened to provide more room for merchandise.

First sheet 12 typically includes a tongue 20 that extends out beyond the upper edge of second sheet 14. Tongue 20 generally defines a pair of openings 22 that allow bag 10 to be mounted on a wicket during storage before bag 10 is filled and sealed. Below tongue 20, bag 10 includes a neck area 24 that includes a sealing area 26. Bag 10 further includes a pocket area 28 disposed below sealing area 26. Each flange 16 defines a tear notch 30 disposed below sealing area 26 such that each tear notch 30 is disposed between sealing area 26 and pocket area 28. Tear notch 30 allows the consumer to open bag 10 after the consumer has purchased bag 10 in a retail store. A secondary seal 32 (see FIG. 3) may be formed in bag 10 to allow the consumer to selectively seal, unseal, and reseal bag 10 while the consumer is consuming the merchandise in bag 10.

FIGS. 2 and 3 show bag 10 being opened, filled, and sealed by an automated filling and sealing machine. The machine includes a pair of finger assemblies 40 that grab and pinch the upper corners of bag 10 to hold bag 10 while it is being opened, filled, and sealed. A problem with prior art bag 10 is that finger assemblies 40 fold flanges 16 back against bag 10 when bag 10 is being held by finger assemblies 40. The folding of flanges 16 results in a plurality of wrinkles 42 to be formed through sealing area 26. When a wrinkled bag 10 is passed through the sealing operation of the automated machinery, wrinkles 42 remain permanently formed in bag 10 when the seal 44 is formed by joining first sheet 12 to second sheet 14 as shown in FIG. 3. Wrinkles 42 thus degrade the appearance of bag 10 and cause fears that seal 44 may leak.

The bag of the present invention is indicated generally by the numeral 50 in FIGS. 4–8. Bag 50 includes many of the same elements described above with respect to prior art bag 10 and the same numbers are used to refer to these elements. In accordance with one of the objectives of the present invention, bag 50 includes a pair of stress relief notches 52 disposed in flanges 16 above sealing area 26 such that sealing area 26 is intermediate stress relief notches 52 and tear notches 30. Each stress relief notch 52 is preferably disposed intermediate the opening to the pocket and sealing area 26. Each stress relief notch 52 must be positioned intermediate sealing area 26 and the upper corners of bag 50. Each stress relief notch 52 divides flange 16 into an upper portion 54 and a lower portion 56.

Figure 6:
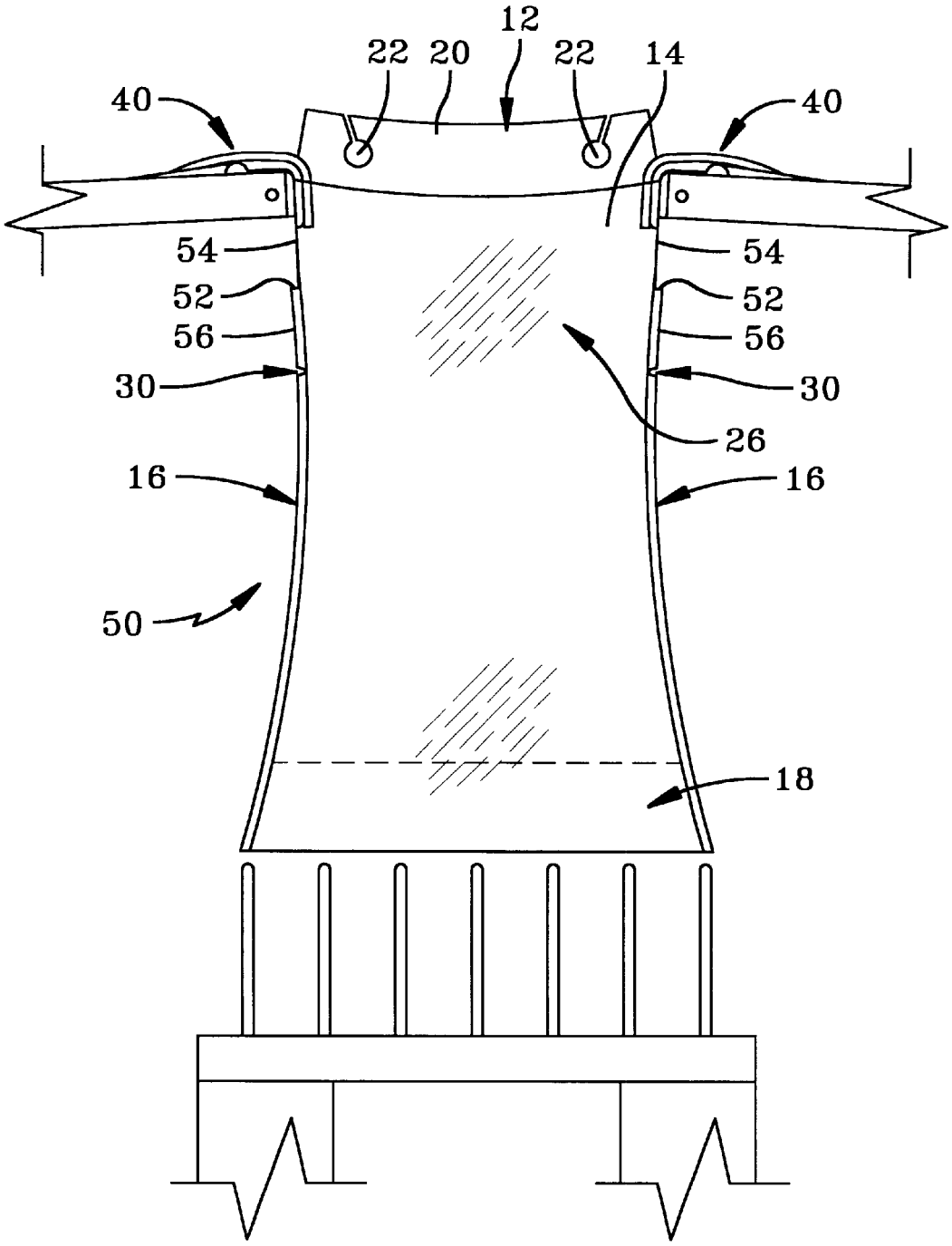
FIG. 6 is a front plan view of the bag of the present invention being held in the filling and sealing machine without creating the wrinkles of the prior art.
Figure 7:
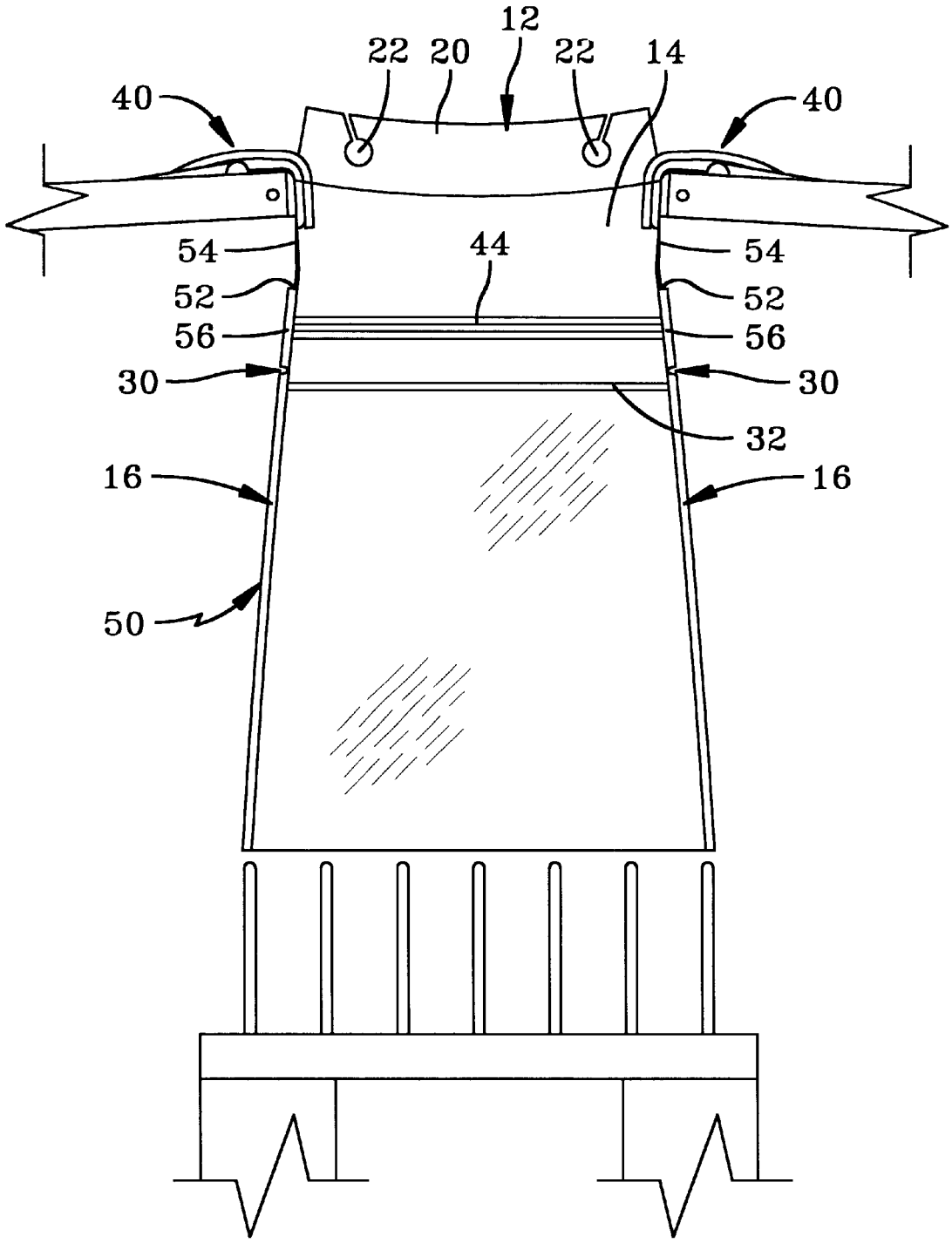
FIG. 7 is a view similar to FIG. 6 showing the bag of the present invention after it has been sealed.
Figure 8:
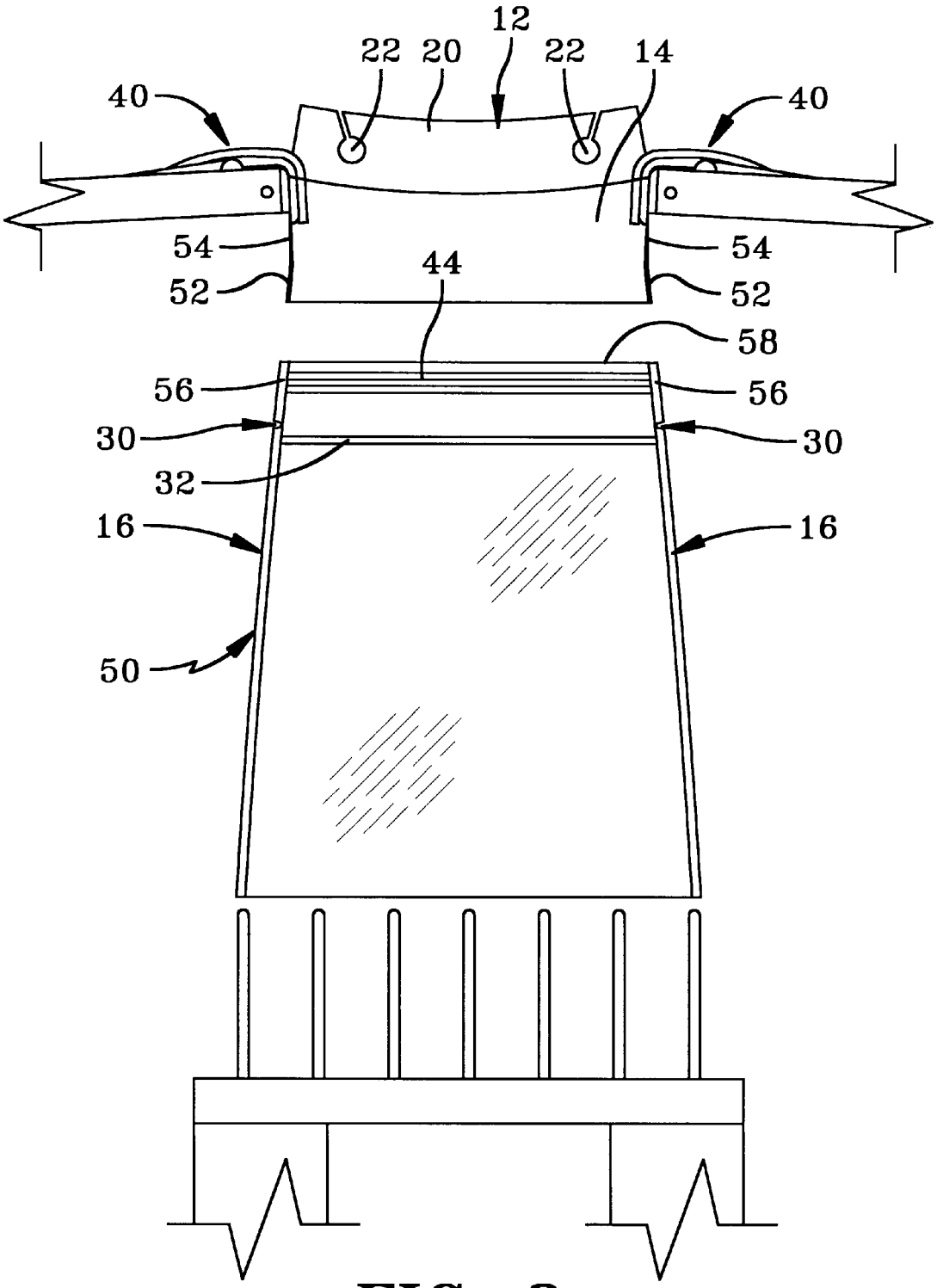
FIG. 8 is a view similar to FIG. 6 showing the bag of the present invention with the top of the neck cut away.

In accordance with the objectives of the invention, stress relief notches 52 allow upper portions 54 of flanges 16 to be folded by finger assemblies 40 without creating wrinkles in sealing area 26. Stress relief notches 52 function by allowing upper portion 54 of flange 16 to fold independent of lower portion 56 when finger assemblies 40 grab the upper corners of bag 50 as shown in FIGS. 6, 7, and 8. Sealing area 26 thus remains substantially smooth and readily accepts seal 44 as shown in FIG. 7 without the wrinkling problem of the prior art.

The top of bag 50 including tongue 20 is cut away from the sealed bag as shown in FIG. 8. The cut line 58 is preferably located intermediate stress relief notches 52 and seal 44. The consumer may then open bag 50 by cutting or tearing between tear notches 30 and using secondary seal 32 to close bag 50.

Each stress relief notch 52 preferably penetrates flange 16 a distance 50 to 90 percent of the width of flange 16. In one common embodiment of bag 50, each flange has a width of 0.25 inches with each stress relief notch having a width of 0.21875 inches. Each stress relief notch 52 is preferably disposed about one to 1 to 1½ inches below the opening of the pocket of bag 50. Stress relief notches 52 must be disposed far enough down along flanges 16 to prevent finger assemblies 40 from grabbing lower portion 56 of flange 16. Each stress relief notch 52 may be a slit as depicted in the drawings. Notches 52 may also be triangular, rounded, square, rectangular, trapezoidal, or any of a variety of other shapes.

In one exemplary embodiment, bag 50 is 11 inches long and 6 inches wide. Each flange 16 is ¼ inch with each stress relief notch 52 being 7⁄32 of an inch. Each stress relief notch 52 is disposed 1⅜ inch down from the top of the pocket with the top of the pocket being disposed 1½ inch from the top of tongue 20. Sealing area 26 is slightly less than 1 inch deep and extends from flange to flange. Each tear notch is disposed 4½ inches from the top of bag 50. In larger bags 50, flanges 16 may be ⅜ inch wide.

Bag 50 is filled and sealed by first grasping the upper corners of bag 50. The pocket of bag 50 may be filled with merchandise before or after the upper corners of bag 50 are grasped by finger assemblies 40. Finger assemblies 40 then move away from each other to pull neck area 24 taut. This action does not create wrinkles in sealing area 26 because upper portions 54 of flanges 16 are folded independent of lower portions 56 of flange 16 as shown in FIGS. 6–8. Bag 50 is then placed in a sealing device that creates seal 44 in sealing area 26 such that seal 44 is disposed intermediate stress relief notches 52 and tear notches 30. The top of bag 50 is then removed as shown in FIG. 8 and a clean, unwrinkled seal 44 may be presented to the consumer.

Accordingly, the improved bag for automated filling and sealing machine apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the bag for automated filling and sealing machine is constructed and used, the characteristics of the construction, and the advantageous new and useful results obtained; the new and useful structures, devices, elements, arrangements, parts, and combinations are set forth in the appended claims.

What is claimed is:

1. A sealable bag for storing merchandise, the bag comprising:

a body forming a pocket that is adapted to receive the merchandise;

the pocket having an opening through which merchandise is placed into the pocket;

the body having a pair of flanges disposed along the sides of the body;

the body having a neck;

the opening of the pocket being disposed at the neck of the body;

the neck having a sealing area;

each of the flanges defining a stress relief notch disposed intermediate the sealing area and the opening of the pocket; and each of the flanges further defining a tear notch; the sealing area being disposed intermediate the tear notch and the stress relief notch.

2. The bag of claim 1, wherein the body includes a gusseted bottom.

3. The bag of claim 1, wherein each of the flanges has a width with each of the stress relief notches having a width in the range of 50 to 95 percent of the width of the flange.

4. The bag of claim 3, wherein each flange has a width of 0.25 inches and each stress relief notch has a width of 0.21875 inches.

5. The bag of claim 3, wherein each flange has a width of 0.375 inches and each stress relief notch has a width of 75 to 90 percent of the width of the flange.

6. The bag of claim 1, wherein the body is formed from first and second sheets joined at the flanges.

7. A sealable bag for storing merchandise, the bag comprising:

a body forming a pocket that is adapted to receive the merchandise;

the pocket having an opening through which merchandise is placed into the pocket;

the body having a pair of flanges disposed along the sides of the body;

the body having a sealing area;

each of the flanges defining a stress relief notch disposed intermediate the sealing area and the opening of the pocket; and each of the flanges further defining a tear notch; the sealing area being disposed intermediate the stress relief notches and the tear notches.

8. The bag of claim 7, wherein the body includes a gusseted bottom.

9. The bag of claim 7, wherein each of the flanges has a width with each of the stress relief notches having a width in the range of 50 to 95 percent of the width of the flange.

10. The bag of claim 9, wherein each flange has a width of 0.25 inches and each stress relief notch has a width of 0.21875 inches.

11. The bag of claim 9, wherein each flange has a width of 0.375 inches and each stress relief notch has a width of 75 to 90 percent of the width of the flange.

12. The bag of claim 7, wherein the body is formed from first and second sheets joined at the flanges.

13. A sealable bag for storing merchandise, the bag comprising:

a body forming a pocket that is adapted to receive the merchandise;

the pocket having an opening through which merchandise is placed into the pocket;

the body having a pair of flanges disposed along the sides of the body;

the neck having a sealing area adapted to be sealed to close the opening of the pocket;

each of the flanges having stress relief means for preventing the sealing area from wrinkling when the bag is sealed; and each of the flanges further defines a tear notch; the sealing area being disposed intermediate the stress relief means and the tear notches.

14. The bag of claim 13, wherein the stress relief means is disposed intermediate the sealing area and the opening of the pocket.

15. The bag of claim 14, wherein the bag has top corners disposed at the opening of the pocket; the stress relief means preventing the flanges from folding over adjacent the sealing area when the top corners of the bag are pinched.

16. The bag of claim 13, wherein the stress relief means includes notches defined by the flanges of the bag.

17. A sealable bag for storing merchandise; the bag being adapted to sealed with automated equipment that includes finger assemblies that grasp and pinch the bag at the upper corners of the bag; the bag comprising:

a body forming a pocket that is adapted to receive the merchandise;

the pocket having an opening through which merchandise is placed into the pocket;

the body having upper corners disposed adjacent the sides of the opening to the pocket;

the body having a pair of flanges disposed along the sides of the body;

the neck having a sealing area adapted to be sealed to close the opening of the pocket;

each of the flanges defining a stress relief notch disposed intermediate the sealing area and the opening of the pocket; each stress relief notch dividing the flange into an upper portion and a lower portion; the upper portion of the flange disposed intermediate the stress relief notch and the upper corner of the body;

a portion of the lower portion of the flange being disposed adjacent the sealing area of the body;

the upper portion of each flange adapted to fold over when the bag is grasped and pinched by the finger assemblies while the lower portion of each flange remains substantially undisturbed to prevent the sealing area from wrinkling; and each flange further defining a tear notch; the sealing area being disposed intermediate the tear notch and the stress relief notch.

18. The bag of claim 17, wherein the body is formed from first and second sheets joined at the flanges.

19. A sealable bag for storing merchandise, the bag comprising:

a body forming a pocket that is adapted to receive the merchandise;

the body having an upper sheet and a lower sheet;

the body having a pair of flanges disposed along the sides of the body where the upper and lower sheets are connected together;

the neck having a sealing area where the upper and lower sheets are connected to close the pocket;

each of the flanges defining a stress relief notch; and each flange further defining a tear notch; the sealing area being disposed intermediate the tear notch and the stress relief notch.

20. The bag of claim 19, wherein the body includes a secondary seal; the tear notches being disposed intermediate the secondary seal and the sealing area.

* * * * *